US005882834A

United States Patent [19]

Maniar

[11] Patent Number: 5,882,834

[45] Date of Patent: Mar. 16, 1999

[54] METHOD OF MAKING DEVELOPER COMPOSITIONS WITH STABLE TRIBOELECTRIC CHARGING PROPERTIES

[75] Inventor: Deepak R. Maniar, Penfield, N.Y.

[73] Assignee: Xerox Corporation, Stamford, Conn.

[21] Appl. No.: 145,118

[22] Filed: Nov. 3, 1993

[51] Int. Cl.[6] ..... G03G 5/00

[52] U.S. Cl. ..... 430/137

[58] Field of Search ..... 430/137

[56] References Cited

U.S. PATENT DOCUMENTS

| | | | |
|---|---|---|---|
| 3,970,571 | 7/1976 | Olson et al. | 427/212 |
| 4,040,969 | 8/1977 | Jones | 427/27 |
| 4,125,667 | 11/1978 | Jones | 428/403 |
| 4,233,387 | 11/1980 | Mammino et al. | 430/137 |
| 4,304,830 | 12/1981 | Bolte et al. | 430/137 |
| 4,678,734 | 7/1987 | Laing et al. | 430/137 |

*Primary Examiner*—Maria Nuzzolillo
*Assistant Examiner*—Laura Weiner
*Attorney, Agent, or Firm*—Oliff & Berridge, PLC

[57] ABSTRACT

A method of preparing a developer composition involves the steps of:

(1) blending carrier particles with finely divided toner particles, wherein blending is carried out for a period of time sufficient to enable the toner particles to alter the tribocharging ability of the carrier particles and become embedded therein;

(2) dividing the blend of toner particles and carrier particles into coarse particles and fine particles; and (3) blending the coarse particles with toner particles.

21 Claims, No Drawings

METHOD OF MAKING DEVELOPER COMPOSITIONS WITH STABLE TRIBOELECTRIC CHARGING PROPERTIES

BACKGROUND OF THE INVENTION

This invention relates to methods of making developer compositions. More particularly, this invention relates to methods for making two-component electrostatographic developer compositions.

Methods of making developer compositions are known in the art. Reference is made, for example, to U.S. Pat. No. 4,678,734 to Laing et al., which discloses a process for making developer compositions comprising (1) providing carrier particles having a core with a coating thereover; (2) introducing the carrier particles into a blending apparatus; (3) adding to the blending apparatus fine toner particles with a diameter of from about 2 microns to about 10 microns, said particles being comprised of toner resin particles, pigment particles, and a charge enhancing additive; (4) effecting blending for a period of time sufficient to enable the classified toner particles to alter the tribogenerating ability of the surface of the carrier particles and become embedded therein; (5) subsequently adding to the resulting blended mixture toner particles of a diameter of from about 2 to about 18 microns, and comprised of toner resin, pigment particles, and a charge enhancing additive; and (6) blending for a period of from about 1 minute to about 5 minutes.

Although the Laing et al. method produces a developer having relatively stable electrical properties, including consistent triboelectric charging values, acceptable charge distributions, and constant conductivity characteristics, it is desirable to provide a method for making a developer which not only provides developers with stable electrical properties but also with improved machine performance.

Typically, after their introduction into a printing apparatus, developers prepared according to known processes require approximately 2½ hours of use before they produce prints having high copy quality, e.g., good image sharpness and substantially no background deposits. Furthermore, developers prepared according to known processes generally require production of a high number of copies, e.g., about 2000 copies, before high quality copies are produced.

SUMMARY OF THE INVENTION

Developers prepared according to the method of this invention require substantially less time and substantially fewer copies to produce high quality printed copies after introduction into a printing apparatus.

The removal of substantially all of the fine particles, e.g., debris, during preparation of the developer according to the method of this invention allows for easier adjustment of the copy quality of the printed copies than would occur in the presence of such particles. In addition, the method for making developer compositions according to the present invention provides developers having stable triboelectric charging values, desirable development properties for substantially unlimited imaging cycles, and excellent triboelectric charging properties for substantially longer periods of time, thereby increasing the developer life of the developer compositions and decreasing the time intervals between replacement of the developer materials.

The method of preparing a developer composition according to the present invention comprises the steps of:

(1) blending carrier particles with finely divided toner particles, wherein blending is carried out for a period of time sufficient to enable the toner particles to alter the tribocharging ability of the carrier particles and become embedded therein;

(2) dividing the blend of toner particles and carrier particles into coarse particles and fine particles; and (3) blending the coarse particles with toner particles.

DETAILED DESCRIPTION OF PREFERRED EMBODIMENTS

Developers prepared according to the method of this invention require substantially less time, e.g., about 2 hours, and substantially fewer copies, e.g., about 500–600 copies, to produce high quality printed copies after introduction into a printing apparatus.

The carrier particles used in the present invention preferably have a diameter of from about 50 to about 250 microns and can be composed of, for example, steel, iron ferrites (such as those disclosed in U.S. Pat. No. 3,914,181, the disclosure of which is totally incorporated herein by reference), and reclaimed ferrites. Other carrier particles not specifically disclosed herein can be selected provided that the objectives of the present invention are achieved.

Carrier particles used in the present invention may or may not have a semicontinuous or continuous coating thereover. Examples of suitable materials for forming the carrier coating include fluoropolymers, terpolymers of styrene acrylate (such as those disclosed in U.S. Pat. Nos. 3,467,634 and 3,526,533, the disclosures of which are totally incorporated by reference herein), siloxanes, polymethyl methacrylates, and the like. A preferred coating is a polyvinylidine fluoride, commercially available as Kynar, present at a coating weight of from about 0.12 to about 0.20 and preferably about 0.155 percent by weight. Other coatings not specifically illustrated herein can be selected provided that the objectives of the present invention are achieved.

Particularly preferred carrier particles for use in this invention comprise an oxidized grit steel core containing thereover a semicontinous or continuous coating of polyvinylidine fluoride. Such carrier particles and methods for preparing them are described in U.S. Pat. No. 4,233,387, the disclosure of which is totally incorporated herein by reference.

The finely divided toner particles used in step (1) of the method of this invention have an average particle diameter preferably ranging from about 2 to about 10 microns, more preferably ranging from about 3 to about 7 microns, and most preferably about 5 microns.

The amount of toner particles used in step (1) will preferably range from about 0.1 to about 1.2 parts by weight, more preferably about 0.15 parts by weight, per 100 parts by weight of carrier particles.

Various suitable known toner compositions can be used in steps (1) and (3) of the method of the present invention, including compositions containing resin, colorant, and charge enhancing additives.

Examples of suitable toner resins are disclosed, for example, in U.S. Pat. No. 4,298,672, the disclosure of which is totally incorporated herein by reference. Such resins include styrene polymers, styrene methacrylates, styrene acrylates, and styrene acrylonitriles, as well as styrene butadiene polymers. Preferred toner resins are styrene methacrylate polymers containing, for example, about 65 percent by weight of styrene and about 35 percent by weight n-butyl methacrylate. Other suitable toner resins include polyesters and polyamide resins.

Numerous well known colorants can be incorporated into the toner. Examples of suitable colorants include carbon black, nigrosine dye, and mixtures thereof. The colorant is preferably a pigment that contains carbon black in an amount of from about 1 percent by weight to about 20 percent by weight and preferably from about 5 percent by weight to about 10 percent by weight.

Examples of suitable charge enhancing additives include alkyl pyridinium halides (such as those disclosed in U.S. Pat. No. 4,298,672, the disclosure of which is totally incorporated herein by reference), sulfonates and sulfates (such as those disclosed in U.S. Pat. No. 4,338,390, the disclosure of which is totally incorporated herein by reference), and ammonium sulfates (such as those disclosed in U.S. Pat. No. 4,560,635, the disclosure of which is totally incorporated herein by reference). A preferred charge enhancing additive for the method of this invention is cetyl pyridinium chloride.

The charge enhancing additive can be incorporated into the toner composition in various effective amounts. Preferably, the amount of charge enhancing additive will range from about 0.1 percent by weight to about 20 percent by weight, and more preferably from about 1 percent by weight to about 10 percent by weight.

The blending step (1) is carried out for a time period sufficient to enable the toner particles to alter or lower the tribogenerating ability of the surface of the carrier particles and to become embedded therein. Blending in step (1) is carried out for a period preferably ranging from about 20 to about 90 minutes and more preferably ranging from about 20 to about 60 minutes.

In step (2) of the method of this invention, the blend of toner particles and carrier particles is separated into coarse particles and fine particles. The term "fine" as used in this context means those particles having an average diameter that is smaller than the average diameter of the toner particles in the blend of carrier and toner particles. The term "coarse" as used in this context refers to those particles having an average diameter greater than or equal to the average diameter of the toner particles in the blend. Preferably, the fine particles are those having a particle size of less than about 2 microns, more preferably having a particle size of from about 0.3 to less than about 2 microns. The fine particles will include debris, the presence of which is undesirable. Examples of debris include dust, carrier tips, and oxide particles. Preferably, coarse particles are those having a particle size of about 2 microns or greater, more preferably those having a particle size ranging from about 2 to about 250 microns.

The coarse particles and fine particles can be separated by any appropriate means. Typically, they are separated by means of classification. Any suitable classification method can be used. Typical particle classification methods include air classification, screening, cyclone separation, elutriation, centrifugation, and combinations thereof.

In step (3) of the method of this invention, the coarse particles from step (2) are blended with toner particles. These toner particles preferably have an average diameter of from about 6 to about 18 microns, more preferably from about 9 to about 12 microns. The toner particles used in step (3) may contain the same materials as the toner particles used in step (1) with the exception that the average diameters of the toner particles are different in the two steps.

The amount of toner particles used in step (3) will preferably range from about 0.8 to about 4.0 parts by weight, more preferably about 2.0 parts by weight, per 100 parts by weight of carrier particles.

In step (3), blending is carried out for a period sufficient to produce a homogeneous mixture of toner particles and carrier particles, and also to permit the toner particles to acquire charge by mixing with and contacting the treated carrier surface. This blending is short, preferably from about 1 minute to about 5 minutes and more preferably about 2 minutes.

The resulting two component electrostatographic developer composition has triboelectric charging values preferably ranging from about 10 to about 40 microcoulombs per gram.

The following examples further define various species of the present invention, it being noted that these examples are intended to illustrate and not limit the scope of the present invention. Parts and percentages are by weight unless otherwise indicated.

EXPERIMENTAL

A carrier blended with toner finely divided particles at a 0.15% by weight toner particle level is classified in a Donaldson classifier at a speed sufficient to remove most of the fines. The air of the classifier also removes dust and other debris generated during the preconditioning cycle. Classification results in a coarse fraction and a fine fraction of the above carrier with most of the material being collected into the coarse fraction. The coarse fraction is then blended in a roll mill with larger particles of the same toner used in the first blending step. The resulting product is then evaluated for triboelectric charging values, triboelectric stability, charge spectra, admix behavior, conductivity, and $\alpha$ values. The term "$A_t$" is equal to triboelectric charge×[toner concentration+1]. The At value is 91, the triboelectric charge value is 18.1 microcoulombs per gram, and the conductivity value is $3.1\times10^{-9}$ (ohm-cm$^{-1}$).

The blend is then subjected to multiple toning/detoning cycles. A toning/detoning cycle refers to a cycle involving adding toner, detoning, measuring conductivity and adding new toner.

The results are shown in the table below. In the table below, "TC" refers to toner concentration and "n" represents the number of toning/detoning cycles prior to evaluation of properties.

TABLE

| Properties After Toning/Detoning | | |
|---|---|---|
| n | $A_t$ | Tribo/TC |
| 0 | 91 | 26.0/2.5 |
| 1 | 70.4 | 23.8/1.96 |
| 5 | 71.3 | 24.1/1.96 |
| 10 | 63.8 | 21.0/2.04 |

After 10 cycles, the developer composition has a conductivity of $4.5\times10^{-8}$ (ohm-cm)$^{-1}$ and an alpha value of 2.40. The term "alpha" refers to the surface aging characteristic of the developer. The higher the alpha value, the more effect aging has had on the developer. The more constant the alpha value, the less effect aging has had.

The results presented in the table show that the developer composition prepared according to the method of the present invention has stable triboelectric charging properties even after repeated cycles. The charge spectra showed no charge attributable to toner, this result being similar to that observed with developers prepared according to methods known in the art. This property should further provide improved machine performance.

The developer composition prepared according to the method of this invention also had triboelectric charge properties comparable to that of the second developer prepared in U.S. Pat. No. 4,678,734 to Laing et al., hereby incorporated by reference herein in its entirety. Thus, the method of this invention provides developer compositions with improved machine performance without sacrificing triboelectric charge properties.

What is claimed is:

1. A method of preparing a developer composition comprising the steps of:

(1) blending carrier particles with finely divided toner particles, wherein blending is carried out for a period of time sufficient to enable the toner particles to alter the tribocharging ability of the carrier particles and become embedded therein;

(2) removing fine particles and debris by dividing the blend of toner particles and carrier particles into coarse particles and fine particles; and (3) blending the coarse particles with toner particles.

2. A method according to claim 1, wherein the finely divided toner particles in step (1) have an average diameter ranging from about 2 to about 10 microns.

3. A method according to claim 1, wherein the finely divided toner particles in step (1) have an average diameter ranging from about 3 to about 7 microns.

4. A method according to claim 1, wherein the fine particles in step (2) have an average diameter of less than about 2 microns.

5. A method according to claim 1, wherein the fine particles in step (2) have an average diameter ranging from about 0.3 to less than about 2 microns.

6. A method according to claim 1, wherein the coarse particles in step (2) have an average diameter of about 2 microns or greater.

7. A method according to claim 1, wherein the coarse particles in step (2) have an average diameter ranging from about 2 to about 250 microns.

8. A method according to claim 1, wherein the toner particles in step (3) have an average diameter ranging from about 6 to about 18 microns.

9. A method according to claim 1, wherein the toner particles in step (3) have an average diameter ranging from about 9 to about 12 microns.

10. A method according to claim 1, wherein blending in step (1) is carried out for a period ranging from about 20 to about 90 minutes.

11. A method according to claim 1, wherein blending in step (3) is carried out for a period ranging from about 1 to about 5 minutes.

12. A method according to claim 1, wherein blending in step (3) is carried out for about 2 minutes.

13. A method according to claim 1, wherein the amount of toner particles blended with carrier particles in step (1) ranges from about 0.1 to about 1.2 parts by weight per 100 parts by weight of carrier particles.

14. A method according to claim 1, wherein the amount of toner particles blended with carrier particles in step (3) ranges from about 0.8 to about 4.0 parts by weight per 100 parts by weight of carrier particles.

15. A method according to claim 1, wherein the carrier particles comprise an oxidized grit steel core containing thereover a semicontinuous or continuous coating of polyvinylidine fluoride.

16. A method according to claim 1, wherein the toner particles in steps (1) and (3) comprise toner resin, colorant, and a charge enhancing additive.

17. A method according to claim 16, wherein the toner resin comprises a styrene n-butyl-methacrylate copolymer.

18. A method according to claim 16, wherein the colorant comprises carbon black.

19. A method according to claim 16, wherein the charge enhancing additive comprises cetyl pyridinium chloride.

20. A developer prepared according to the method of claim 1.

21. A method of preparing a developer composition comprising the steps of:

(1) blending carrier particles with classified toner particles having an average diameter of about 5 microns, wherein the toner particles are blended with the carrier particles in an amount of 0.15 parts by weight of toner particles per 100 parts by weight of carrier particles, further wherein blending is carried out for a period ranging from about 20 to about 60 minutes, the toner particles comprising styrene n-butylmethacrylate copolymer, carbon black pigment particles, and cetyl pyridinium chloride;

(2) classifying the blend of toner particles and carrier particles into coarse particles having a particle size of about 2 microns or greater and fine particles having an average diameter of less than about 2 microns; and (3) blending for about 2 minutes the coarse particles with toner particles of an average diameter of from about 9 to about 12 microns, wherein the toner particles are blended with the carrier particles in an amount of about 2.0 parts by weight of toner particles per 100 parts by weight of carrier particles, the toner particles comprising styrene n-butyl-methacrylate copolymer, carbon black pigment particles, and cetyl pyridinium chloride.

* * * * *